US006989793B2

(12) United States Patent
Van Der Poel

(10) Patent No.: US 6,989,793 B2
(45) Date of Patent: Jan. 24, 2006

(54) PATCH FED PRINTED ANTENNA

(75) Inventor: Stephanus Hendrikus Van Der Poel, Haaksbergen (NL)

(73) Assignee: Thales Nederland B.V., (NL)

( * ) Notice: Subject to any disclaimer, the term of this patent is extended or adjusted under 35 U.S.C. 154(b) by 0 days.

(21) Appl. No.: 10/488,793

(22) PCT Filed: Sep. 24, 2002

(86) PCT No.: PCT/IB02/03923

§ 371 (c)(1),
(2), (4) Date: Mar. 5, 2004

(87) PCT Pub. No.: WO03/028156

PCT Pub. Date: Apr. 3, 2003

(65) Prior Publication Data

US 2004/0239567 A1 Dec. 2, 2004

(30) Foreign Application Priority Data

Sep. 24, 2001 (NL) ..... 1019022

(51) Int. Cl.
*H01Q 1/38* (2006.01)

(52) U.S. Cl. ..... 343/700 MS; 343/767

(58) Field of Classification Search ..... 343/700 MS, 343/767, 848

See application file for complete search history.

(56) References Cited

U.S. PATENT DOCUMENTS 4,464,663 A 8/1984 Lalezari et al. ..... 347/700 MS
5,241,321 A 8/1993 Tsao ..... 343/700 MS
5,448,250 A * 9/1995 Day ..... 343/700 MS
5,745,080 A 4/1998 Jun ..... 343/700 MS
5,907,305 A * 5/1999 Epp et al. ..... 343/700 MS
6,018,319 A 1/2000 Lindmark ..... 343/700 MS
6,018,320 A 1/2000 Jidhage et al. ..... 343/700 MS
6,281,845 B1 * 8/2001 Ittipiboon et al. ... 343/700 MS
6,346,913 B1 * 2/2002 Chang et al. ..... 343/700 MS
6,424,299 B1 * 7/2002 Cha et al. ..... 343/700 MS

OTHER PUBLICATIONS

Hall; "Dual Polarisation Antenna Arrays With Sequentially Rotated Feeding"; IEEE Proceedings H. Microwaves, Antennas & Propagation, Institution of Electrical Engineers, Stevenage, GB; vol. 139, No. 5; Oct. 1, 1992; pp. 465-471; XP000355102.

* cited by examiner

*Primary Examiner*—Shih-Chao Chen

(74) *Attorney, Agent, or Firm*—Lowe Hauptman & Berner, LLP

(57) ABSTRACT

The disclosure relates to a printed antenna fed by a patch. The printed antenna includes at least one ground plane with a radiating opening in it, this radiating opening being arranged to radiate into the space situated above said ground plane, and a conductive feed patch placed beneath said radiating opening and insulated by a dielectric layer, in such a way that the patch is coupled to the radiating opening in order to feed the radiating opening without parasitic radiation being excited. It also concerns printed antennas with two polarization directions and corresponding antenna arrays.

11 Claims, 9 Drawing Sheets

PATCH FED PRINTED ANTENNA

This application is a 371 of PCT/1B02/03923 filed on Sep. 24, 2002.

The invention concerns a printed antenna fed by a patch. More particularly, it refers to a printed antenna with two polarisations and an array of these antennas.

Printed antennas are light and take up little space. They can be produced in large series, so they are cheap. They are used for various purposes, such as for TV reception by satellite (receiving antenna), for telecommunications (sending/receiving antennas), for application on board of objects such as satellites, aircraft or rockets, and for portable equipment such as a small portable radar or radio probe.

A printed antenna consists usually of a stack of layers. The top layer is a radiating layer. The radiating layer includes one or more radiating elements. These radiating elements may be conductive patches, usually square, rectangular or circular in shape. A ground plane is generally used, placed beneath the radiating layer insulated from it by means of one or more dielectric layers. The ground plane serves as a mirror to limit the radiation to the space located in front of it. The dielectric layer may be air or a substrate, such as foam.

A radiating patch can be fed in various ways. The most commonly used are:

- the micro-strip line feed, where the micro-strip line is connected with the radiating patch;
- the coaxial-line feed, where the inner conductor of the coax is attached to the radiating patch, while the outer conductor is connected to the ground plane;
- the micro-strip line coupling, where the micro-strip line is located between the radiating patch and the ground plane;
- the aperture/slot coupling, where a feed line is located beneath an opening in the ground plane, the feed line being insulated from the ground plane with the aid of a dielectric layer. The feed line can be screened by adding a ground plane beneath it, whereupon a three-layer line ("strip-line") is formed.

The micro-strip line feed and the coaxial line feed possess inherent asymmetries generating higher order modes that produce cross-polarized radiation. The micro-strip line coupling may be symmetrical, but this results in losses; also, assembly is more expensive, and layout problems arise, especially with array antennas.

These problems can be resolved by the aperture/slot coupling. This certainly shifts the problem to the feed of the radiating opening itself. It is in fact the case that the coupling between a line and a radiating opening excites parasitic radiation. This parasitic radiation is, moreover, a particular nuisance with array antennas because it may cause parasitic couplings between the radiating elements. Moreover, these antennas have a small bandwidth.

For antennas with two polarisation directions, the feed assembly is complex and expensive because the feed lines must be insulated from each other at the points where they cross. An antenna of this kind is described, for example, in patent application U.S. Pat. No. 5,448,250. Here, the feed lines are insulated at the places where they cross with the aid of insulating bridges. A structure of this kind does not lie on one plane; it is not symmetrical and it is complex and expensive. Moreover, parasitic coupling can arise at the point where two lines cross. Finally, there is also the problem of the insulation between the two connecting points corresponding to the two polarisation directions.

The purpose of the invention is in particular to deal with these objections in the state of the art. More accurately, the purpose of the invention is to provide a printed antenna with the radiating element fed in an effective way without parasitic radiation being excited in consequence, but with a large bandwidth.

For this purpose, the antenna according to the invention is equipped with:

(a) a conductive ground plane, with a radiating opening in it, which radiating opening is designed to radiate into the space above the ground plane;

(b) a conductive feed patch placed beneath the radiating opening and insulated by a dielectric layer, in such a way that the patch is coupled with the radiating opening to feed the radiating opening without parasitic radiation being excited.

According to an advantageous embodiment, the vertical projection of the radiating opening is substantially surrounded by the feed patch.

According to an advantageous embodiment the antenna further includes:

(c) a second conductive ground plane placed beneath the feed patch and insulated by a dielectric layer in such a way that together with the feed patch a three-layer assembly is formed.

According to an advantageous embodiment, the antenna further includes:

(d) one or more conductive radiating patches placed above the radiating opening and insulated by one or more dielectric layers, in such a way that the conductive radiating patches are coupled with the radiating opening to radiate out into the space above.

The invention also concerns the design of antennas with two polarisation directions. In this case, according to a preferred embodiment, the feed patch being substantially symmetrical about an axis, two feed lines are connected to said patch symmetrically about said axis, these lines being intended to be fed simultaneously in phase or in counter phase in order to produce two polarisations.

Through this application, according to an advantageous embodiment, the feed patch is substantially square in design and the two feed lines are connected to two consecutive sides. This enables two linear polarisation directions at right angles to each other with high polarisation purity.

For this application the feed lines are, according to a preferred embodiment, linked to a magic T, where the sum and differential inputs to the magic T form the inputs, independently for each polarisation. In this way, the insulation between the two corresponding inputs can be improved for the two polarisation directions. The magic T is preferably of the rat-race type.

The invention also refers to the design of antenna arrays, which contain at least two antennas as defined above, fitted with all or part of the favourable variants.

According to a preferred embodiment, the antenna array includes a feed network printed on the surface of the feed patches. According to a preferred embodiment, the antenna array includes a feed network printed on a surface other than the surface on which the feed patches are placed, insulated from the latter surface by a dielectric layer, a ground plane and another dielectric layer, placed on the other side of the ground plane, and linked to the surface of the feed patches by vertical connections through the ground plane and dielectric layers. The vertical connections are here preferably of screened design.

The main advantage of the invention is that it is simply achieved, that it is modular and that it is relatively cheap.

Other characteristics and advantages of the invention will become evident on reading the detailed description below of a potential embodiment, which is non-limitative and taken only as an example, with reference to the attached drawings of which:

Figure 12:
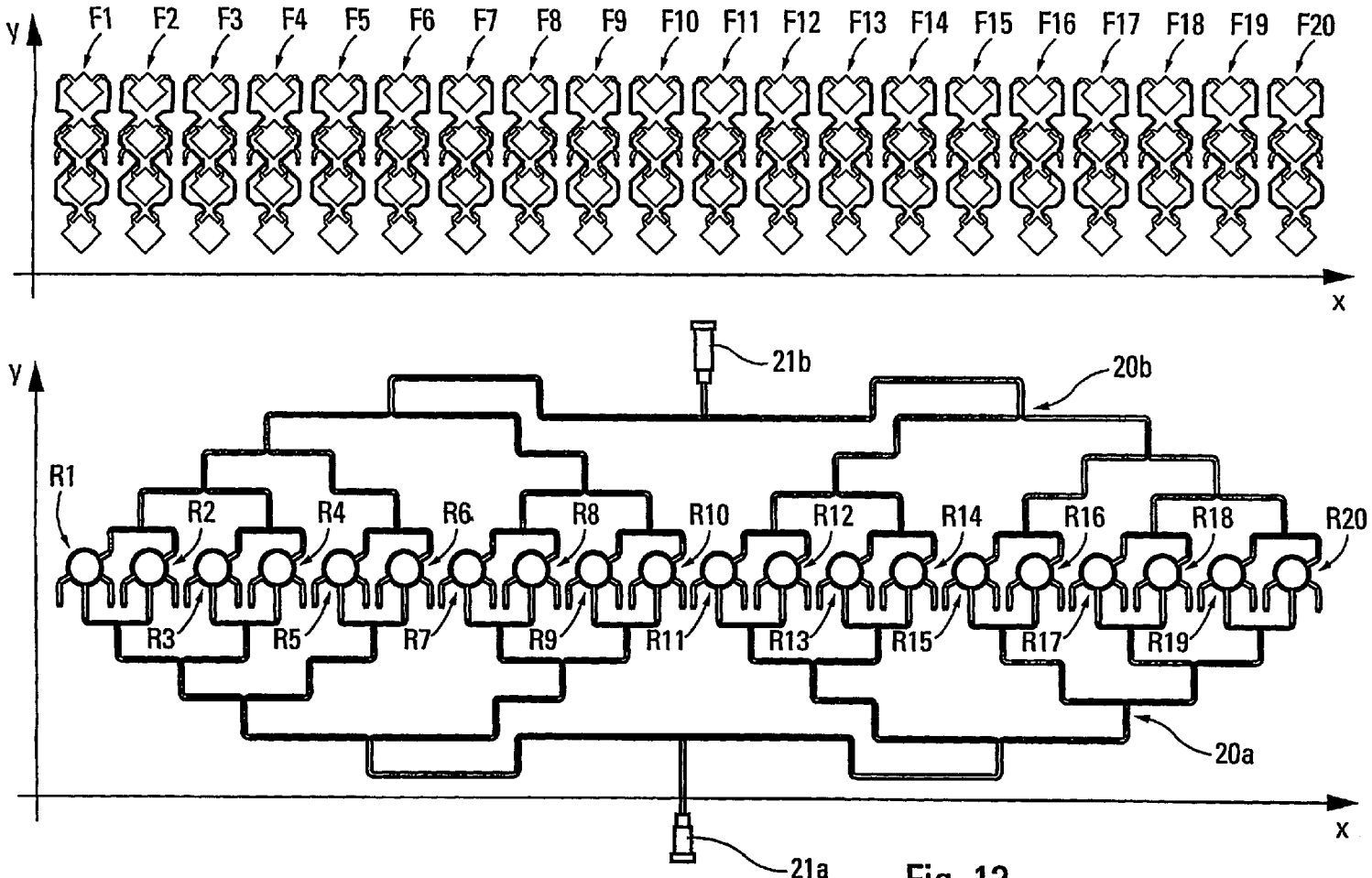

FIG. 12 a top view represents two layers that correspond to a preferred embodiment of an antenna array according to the invention, these layers forming a printed feed network whereby a major array antenna can be realised and whereupon the feed network is partly printed on the layer on which the feed patches are located and partly on the layer on which the rat-races are located.

In the description below we see a printed antenna with two polarisation directions, with which two orthogonal polarisations can be achieved. However, it is clear that the invention can also be applied to other types of antennas. An antenna with only one polarisation direction is in fact a simplified form of this. An antenna with a circular polarisation direction can be inferred from it by adding a phase rotation of 90° to one of the polarisation directions.

Figure 1:
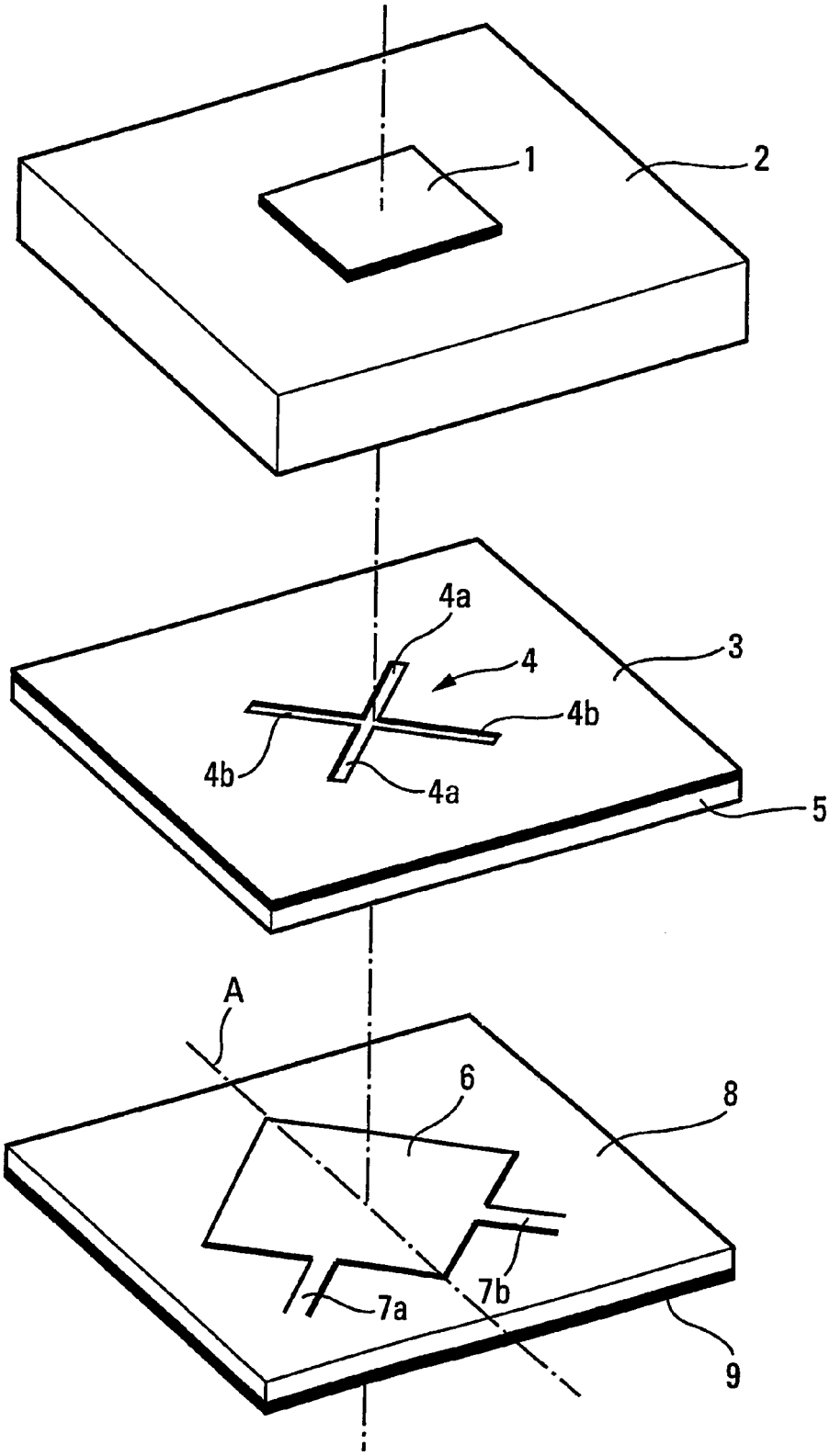
FIG. 1 represents in perspective an exploded drawing of a preferred embodiment of the invention.
Figure 2:
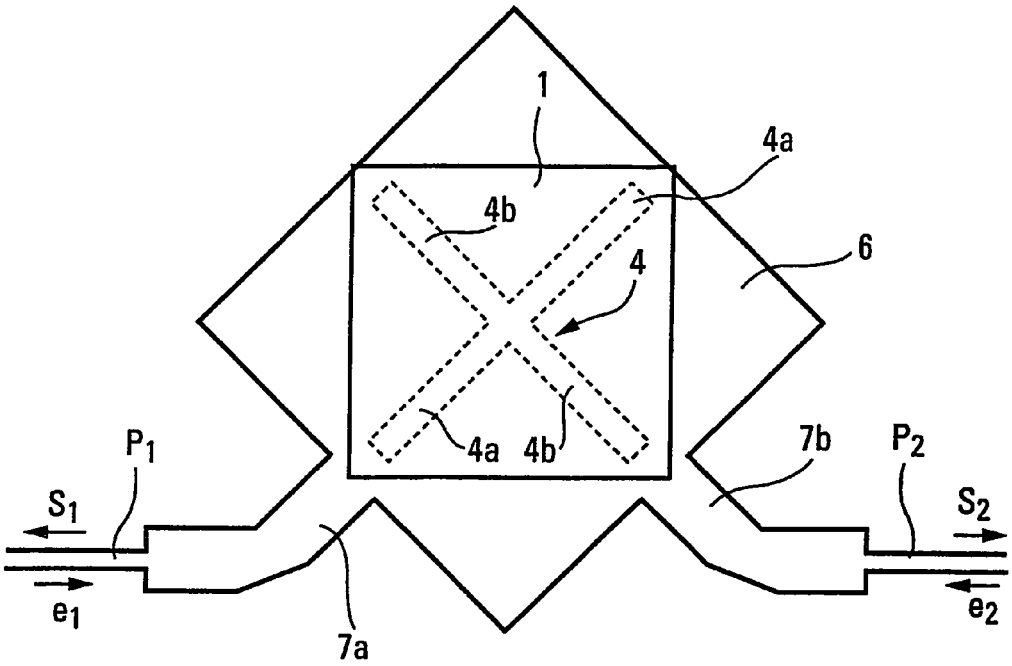
FIG. 2 represents a top view of the antenna elements as shown in FIG. 1.

As represented in FIGS. 1 and 2 and in accordance with a preferred embodiment, the printed antenna according to the invention includes at least:

(a) one conductive ground plane 3 including a radiating opening 4 arranged to radiate into the space lying above the ground plane;

(b) one conductive feed patch 6, placed beneath the radiating opening 4 and insulated by a dielectric layer 5, in such a way that the patch is coupled with the radiating opening so as to feed the radiating opening without parasitic radiation being excited.

The radiating opening 4 may be an opening in ground plane 3 in the shape of a cross, formed by two slots 4*a* and 4*b*. These slots can have the same length and the same width and be set at right angles to each other, such that they intersect in their middle. The slots may, for example, have a length of 44 mm and a width of 4 mm.

Because the radiating opening 4 is fed by a patch and not by lines, the creation of parasitic radiation and of a coupling between the lines is avoided. To achieve this effect, the dimensions of the patch are selected in relation to the dimensions of opening 4. The bigger the selected feed patch 6, the lesser the parasitic radiation at its edges. According to a preferred embodiment, the vertical projection of the radiating opening 4 is selected such that it falls substantially within the feed patch 6.

The dimensions of the radiating opening 4 and on the feed patch 6 may be selected according to the frequency band used. It may be noted in this connection that the invention allows a wider wage band to be achieved with fully identical dimensions than under existing techniques.

The feed patch may, for example, be substantially square in shape. The sides of this square may be placed in parallel to two orthogonal directions determined by the cross 4. The centre points of square 6 and cross 4 may coincide here in the horizontal plane. The square may for example have sides of 56 mm.

The antenna will additionally preferentially include:

(c) a second conductive ground plane 9, placed beneath the feed patch 6 and insulated by a dielectric layer 8 in such a way that a three-layer assembly is formed together with the feed patch.

The second ground plane allows the antenna radiation to be reflected to the space above in order thereby to enlarge the yield from the antenna. It also provides protection between the feed patches and any layers underneath.

The dielectric layers 5 and 8 may consist of air or layers of substrate such as e.g. foam. Two layers of foam may, for example, be used 3 mm thick and with a dielectric constant of 1.06.

The antenna will additionally preferentially include (d) one or more conductive radiating patches placed above the radiating opening and insulated by dielectric layers in such a way that they are coupled with the radiated opening, so as to radiate out into the space above.

The antenna as represented in FIG. 1 includes 7 layers, 4 conductive layers and 3 dielectric layers. From the top layer leading downwards one finds:

- a conductive layer, formed by a conductive radiating patch 1;
- a dielectric layer 2;
- a conductive layer, formed by a ground plane 3, which contains the radiating opening 4;
- a dielectric layer 5;
- a conductive layer, formed by the conductive feed patch 6;
- a dielectric layer 8; and
- a conductive layer, formed by the second ground plane 9.

To improve the polarisation purity, the radiating patch 1 is preferably substantially square in shape. The dimensions of this patch correspond to a resonance frequency.

According a preferred embodiment, the vertical projection of the radiating opening is substantially surrounded by the feed patch. One side of the radiating patch 1 is for example 48 mm in length, and layer 2 consists e.g. of foam 10 mm thick, with a dielectric constant of 1.06.

A number of radiating patches of the same type are preferentially stacked on patch 1 in order to increase the bandwidth. Of course, the radiating patches are separated by layers of dielectric matter.

Feed patch 6 may be linked to two feed lines 7*a* and 7*b*. The terminals $P_1$ and $P_2$ of the line 7*a* and 7*b* may form the feed points for the antenna. These feed points $P_1$, $P_2$ are linked for example to a connector (not shown) which is in turn linked to a coaxial cable.

Figure 3:
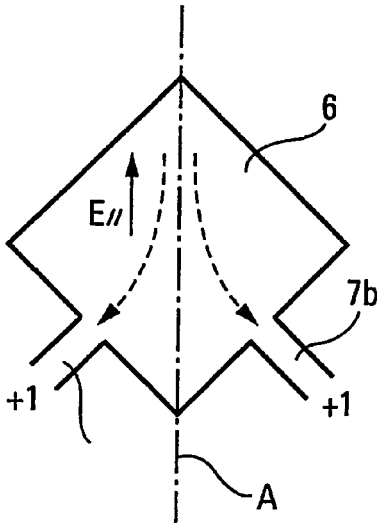
FIGS. 3 and 4 represent the surface flows and polarity of the induced voltages in a feed patch as shown in FIG. 2.
Figure 4:
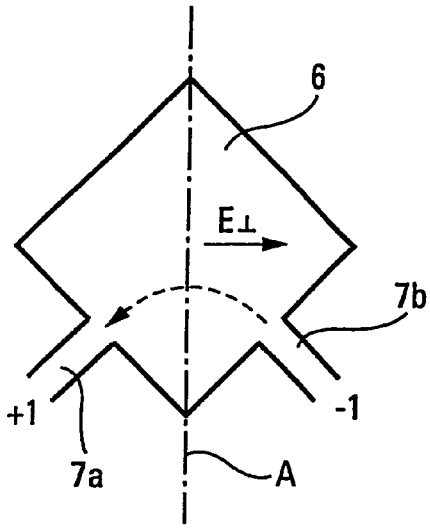

As represented in FIGS. 3 and 4, in accordance with a preferred embodiment, the feed lines 7*a* and 7*b* are symmetrical in relation to a symmetrical axis A of the feed patch 6. They are fed simultaneously in order to produce the one or other polarisation. By feeding the lines in phase with the same amplitude, as indicated in FIG. 3, an initial polarisation is obtained $E_{//}$ (polarisation of the electrical field), known as the parallel polarisation. The surface flows represented by the unbroken lines are symmetrical to the axis A. The polarisation produced is therefore parallel to the symmetrical axis A. By feeding the patches in counter phase as indicated in FIG. 4, a second polarisation is obtained $E_{\perp}$, known as the perpendicular polarisation. The surface flows intersect the symmetrical axis A at right angles. The polarisation produced is therefore at right angles to the symmetrical axis A.

In other words, the two feed points $P_1$ and $P_2$ may be used both to feed the two lines in phase and to feed the two lines in counter phase. An initial polarisation $E_{//}$ can therefore be produced if the lines are fed in phase and a second polarisation $E_{\perp}$ if the lines are fed in counter phase. Thanks to this simultaneous feed, the supply to the antenna is symmetrical and high polarisation purity is obtained. Reference is made below to FIGS. 1 to 4. The feed lines 7*a* and 7*b* are preferably connected to two consecutive sides of the square forming the feed patch 6. In other words, the symmetrical axis A in relation to which the feed lines are placed, is a diagonal of the square. The squares forming the feed patch 6 and the radiating patch 1 are rotated 45° to each other in the horizontal plane. In other words, the diagonals of the square forming the feed patch 6 run parallel to the sides of the radiating patch 1.

Figure 5:
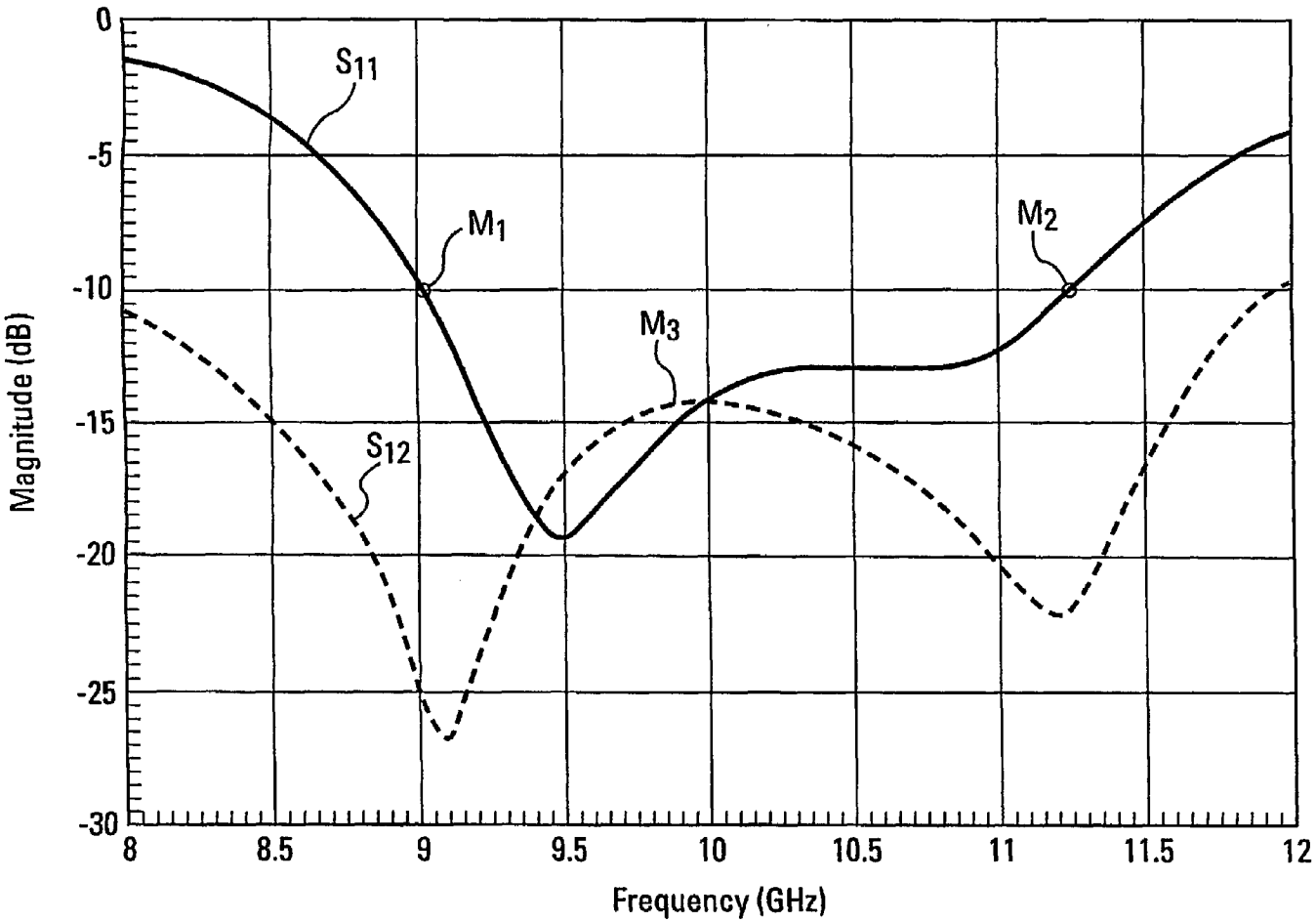
FIG. 5 shows, as a function of the frequency, the change in two curves of the amplitude of the coefficients of the dispersion matrix of the antenna as shown in FIG. 1.

Reference is made to FIG. 5 below where curves are represented as a function of the frequency for the change in the amplitude of the coefficients of the dispersion matrix of the antenna shown in FIG. 1. As a reminder, the dispersion matrix (also referred to as the redistribution matrix) allows the characteristics to be determined of the outgoing waves, emitted from the waves that enter the structure. We consider the structure with two inputs $P_1$ and $P_2$, formed by the antenna as represented in FIG. 1. Assume $e_1$ and $e_2$ are the waves that enter at $P_1$ and $P_2$. Assume $s_1$ and $s_2$ are the waves that leave $P_1$ and $P_2$. In addition, $S_{11}$, $S_{12}$, $S_{21}$ and $S_{22}$ are the coefficients of the dispersion matrix. This matrix enables us, on the basis of $e_1$ and $e_2$, to determine $s_1$ and $s_2$ in the following way:

$$\begin{bmatrix} s_1 \\ s_2 \end{bmatrix} = \begin{bmatrix} S_{11} & S_{12} \\ S_{21} & S_{22} \end{bmatrix} \begin{bmatrix} e_1 \\ e_2 \end{bmatrix}$$

Because the structure contains no non-reciprocal elements, such as ferrites, the dispersion matrix is symmetrical. In other words, the transmission coefficients between the two inputs are dependent on the direction, which is clear from the equality of the coefficients $S_{12}$ and $S_{21}$. In addition, the structure is symmetrical in relation to inputs $P_1$ and $P_2$ so that the coefficients $S_{11}$ and $S_{22}$ are equal.

In FIG. 5, two curves $S_{11}$ and $S_{12}$ are represented with the amplitude in dB along the ordinate and the frequency in GHz along the abscissa. Curve $S_{11}$ (equal to $S_{22}$) is a measure for the reflections. As a reminder, a reflection of −10 dB corresponds to a fixed wave ratio of 2.0. Curve $S_{11}$ appears at a lower level than −10 dB between two points $M_1$ and $M_2$ on this curve. The points $M_1$ and $M_2$ are placed at 9 and 11.25 GHz respectively. In other words, the transmission band that corresponds to a fixed wave relationship of less than 2.0 is 9–11.25 GHz. Between these two points the maximum $M_3$ of the curve $S_{12}$ (equal to $S_{21}$) remains lower than −10 dB. We therefore have a structure that on the one hand has favourable properties in relation to the insulation between its inputs (curve $S_{12}$ lower than −10 dB) and, on the other, produces little reflection (curve $S_{11}$ lower than −10 dB) in an area between 9 and 11.25 GHz.

The invention also refers to the design of antenna arrays consisting of at least two antennas as defined above. According to the state of the art, a problem of location arises when designing antenna arrays because the attempt must be made to prevent coupling between lines. This problem is still far more important for antennas with two polarisation directions. This comes down to complex solutions where little progress can be seen. The antenna according to the invention allows this problem to be solved.

Figure 6:
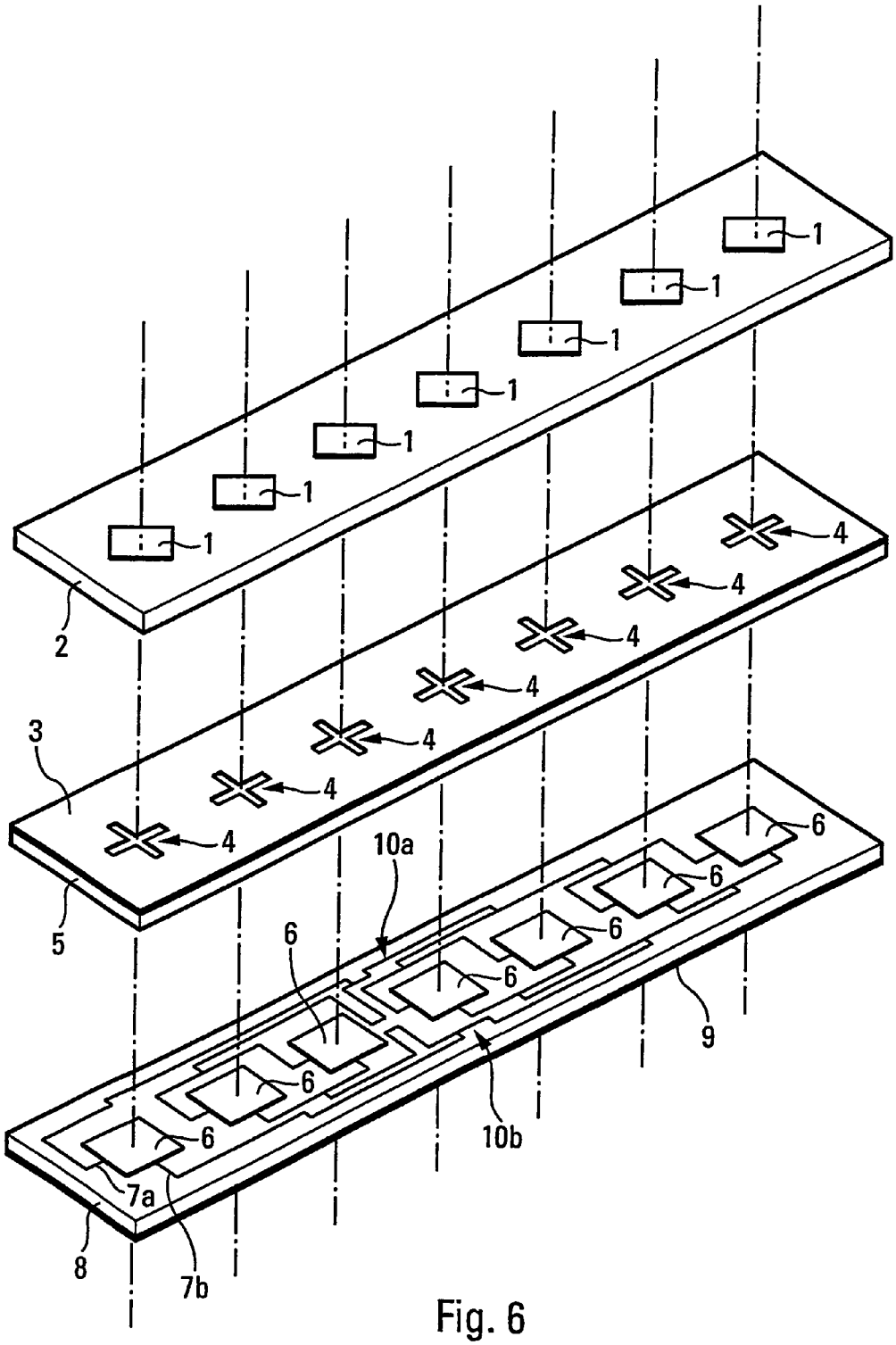
FIG. 6 represents a preferred embodiment in perspective in an exploded drawing of an array antenna according to the invention.

Reference is made below to FIG. 6. Here an example is shown of an antenna array according to the invention. The array includes seven antennas of the type shown in FIG. 1. These antennas are printed on the same layers and are ligned up along a horizontal axis (not shown). The feed patches may be linked by a feed network 10*a*, 10*b* printed on the same layer as the patches.

The feed lines 7*a* may be interlinked by a part 10*a* of the feed network. The feed lines 7*b* may be similarly interlinked by the other part 10*b* of the feed network. The feed network 10*a*, 10*b* as represented in FIG. 6 is a parallel feed network. It goes without saying that a serial feed network can also be applied. The lines that form the feed network 10*a*, 10*b* are matched to all the connections (not shown in this diagram).

The lines of the feed network cause no parasitic radiation because they are separated from the radiating elements by the ground plane 5. Because one need no longer worry about parasitic radiation, the design of the feed network is simplified. In other words, in order to combine antennas in accordance with the invention into an antenna array, it is sufficient to add a feed network to the layer with e.g. the feed patches 6. The areas according to the invention are therefore highly modular, which allows an antenna array to be designed simply and quickly while this design can simply evolve further.

Figure 7:
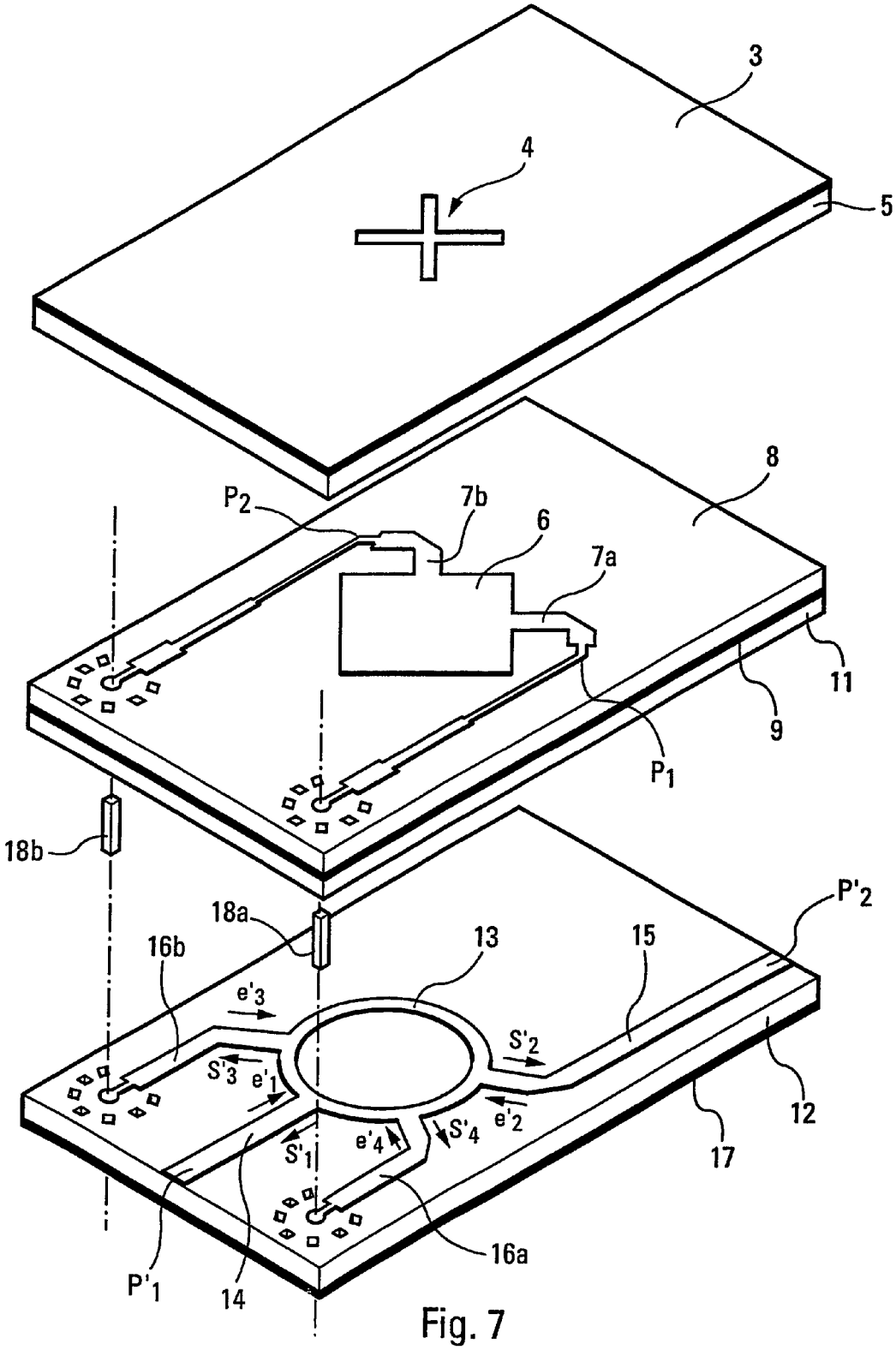
FIG. 7 represents a preferred embodiment in perspective in an exploded drawing of an antenna according to the invention, where the feed lines are connected to a magic T of the "rat-race" type.
Figure 9:
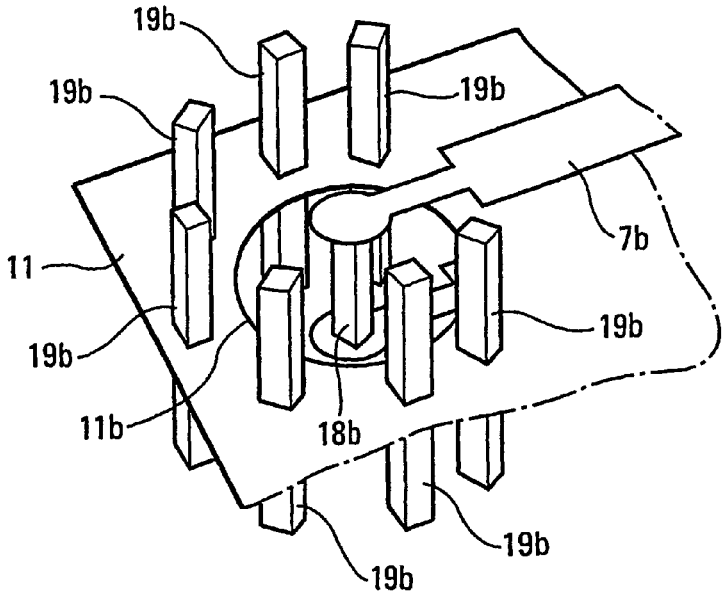
FIG. 9 represents a detail of the antenna as shown in FIG. 7 in perspective in an exploded drawing.

As represented in FIGS. 7 and 9, a magic T can be simply added to the antenna structure represented in accordance with FIG. 1. For clarification, the top layers in FIG. 7 that contain the radiating patch 1 and the dielectric layer 2 are not shown. The feed lines 7*a* and 7*b* are linked to the magic T 13.

As a reminder, the magic T is a structure with 4 inputs (indicated by 1 to 4) linked as follows by a dispersion matrix (see FIG. 7):

$$\begin{bmatrix} s'_1 \\ s'_2 \\ s'_3 \\ s'_4 \end{bmatrix} = \frac{1}{\sqrt{2}} \begin{bmatrix} 0 & 0 & 1 & 1 \\ 0 & 0 & 1 & -1 \\ 1 & 1 & 0 & 0 \\ 1 & -1 & 0 & 0 \end{bmatrix} \begin{bmatrix} e'_1 \\ e'_2 \\ e'_3 \\ e'_4 \end{bmatrix}$$

Indices 1 and 2 correspond to the inputs usually referred to as the sum input and differential input. These inputs are used as new inputs $P_1$' and $P_2$' for the antenna. The two other inputs (corresponding to indices 4 and 3) of the magic T are linked to the lines 7*a* and 7*b* that proceed to the feed patch 8, 6.

If sum input $P_1'$ (wave $e'_1$) is used, we obtain:
on line 7*a*, a wave in phase with the input $$s_4' = \frac{1}{\sqrt{2}} e_1'$$

on line 7*b*, a wave in phase with the input $$s_3' = \frac{1}{\sqrt{2}} e_1'$$

If differential put $P_2'$ (wave $e'_2$) is used, we obtain:
on line 7*a*, a wave in counter phase $$s_4' = -\frac{1}{\sqrt{2}} e_2'$$

on line 7*b*, a wave in phase $$s_3' = \frac{1}{\sqrt{2}} e_2'$$

The patch is therefore fed simultaneously or in phase or in counter phase depending on whether the sum input or a differential input is used. The magic T therefore allows a single feed to be used to obtain any polarisation. In other words, the sum input $P_1'$ and the differential input $P_2'$ form two independent inputs for the various polarisation directions of the antenna. Input $P_1'$ corresponds to a parallel polarisation E//. Input $P_2'$ corresponds to a perpendicular polarisation $E_\perp$.

The dispersion matrix corresponding to the antenna structure according to FIG. 1 can be used to determine the behaviour of the antenna together with the magic T. The outgoing waves $S'_3$ and $S'_4$ of the magic T respectively become the incoming waves $e_2$ and $e_1$ of the antenna as represented in FIG. 1. The outgoing waves $s_2$ and $s_1$ similarly become the incoming waves $e'_3$ and $e'_4$ of the magic T.

If sum input $P_1'$ (wave $e'_1$) is used, we obtain:

with $P_1'$, an outgoing wave $(S_{11}+S_{12})\, e'_1$ corresponding to a reflection (reflection loss);

with $P_2'$, no outgoing wave, in other words a perfect insulation as against $P_1'$.

If the differential input $P_2'$ (wave $e'_2$) is used, we obtain:

with $P_1'$, no outgoing wave, in other words perfect insulation in relation to $P_2'$;

with $P_2'$, an outgoing wave $(S_{11}-S_{12})\, e'_2$ corresponding to a reflection (reflection loss).

The magic T therefore transfers the leak between the inputs $P_1$ and $P_2$ into reflection losses. In other words, the magic T allows the insulation between the two new inputs $P_1'$ and $P_2'$ to be improved. This is a favourable consequence of the symmetrical structure of the antenna according to the invention.

The magic T is preferably of the "rat-race" type and is formed by printed lines. A line 14 may for example link the sum input on the magic T to a connector, and a line 15 may for example link the input on the magic T to another connector. A line 16*b* may connect the input corresponding to index 3 on the magic T with the line 7*b*. A line 16*a* may link the input corresponding to index 4 on the magic T with the line 7*a*.

The magic T 13 represented in FIG. 7 is placed on a different level from the level for the feed patch 8. As will be seen below, this is done in order to simplify the assembly of the antenna. The magic T can of course be placed on the same level as the patch if there is sufficient space. In the example, the magic T is placed beneath the ground plane 9. A dielectric level 11 insulates it from the latter. Two vertical connections formed by conducting paths 18*a* and 18*b* run through the dielectric layers 8, 11 and the ground plane 9. The connection 18*a* links the line 7*a* to line 18*a* on the one hand and the connection 18*b* links the line 7*b* with the line 16*b* on the other hand. The antenna in this example includes 11 layers, of which 6 are conductive and 5 are dielectric layers. Proceeding from the top layer downwards we find:

- a conductive layer, formed by the conductive radiating patch 1;
- a dielectric layer 2;
- a conductive layer, formed by the ground plane 3, which contains a radiating opening 4;
- a dielectric layer 5;
- a conductive layer formed by the conductive feed patch 6;
- a dielectric layer 8;
- a conductive layer formed by the second ground plane 9;
- a dielectric layer 11;
- a conductive layer that contains the magic T 13;
- a dielectric layer 12; and,
- a conductive layer, formed by a bottom ground plane 17.

As indicated in FIG. 9, according to a preferred embodiment, the vertical connections 18*a* and 18*b* are screened. They can be screened by combinations 19*a* and 19*b* of vertical paths fitted round the connections 18*a* and 18*b*. These conductive paths may be connected to the ground plane 11. The ground plane 11 includes two openings 11*a* and 11*b* so that the paths 18*a* and 18*b* can pass without entering into contact with the said ground plane.

Figure 10:
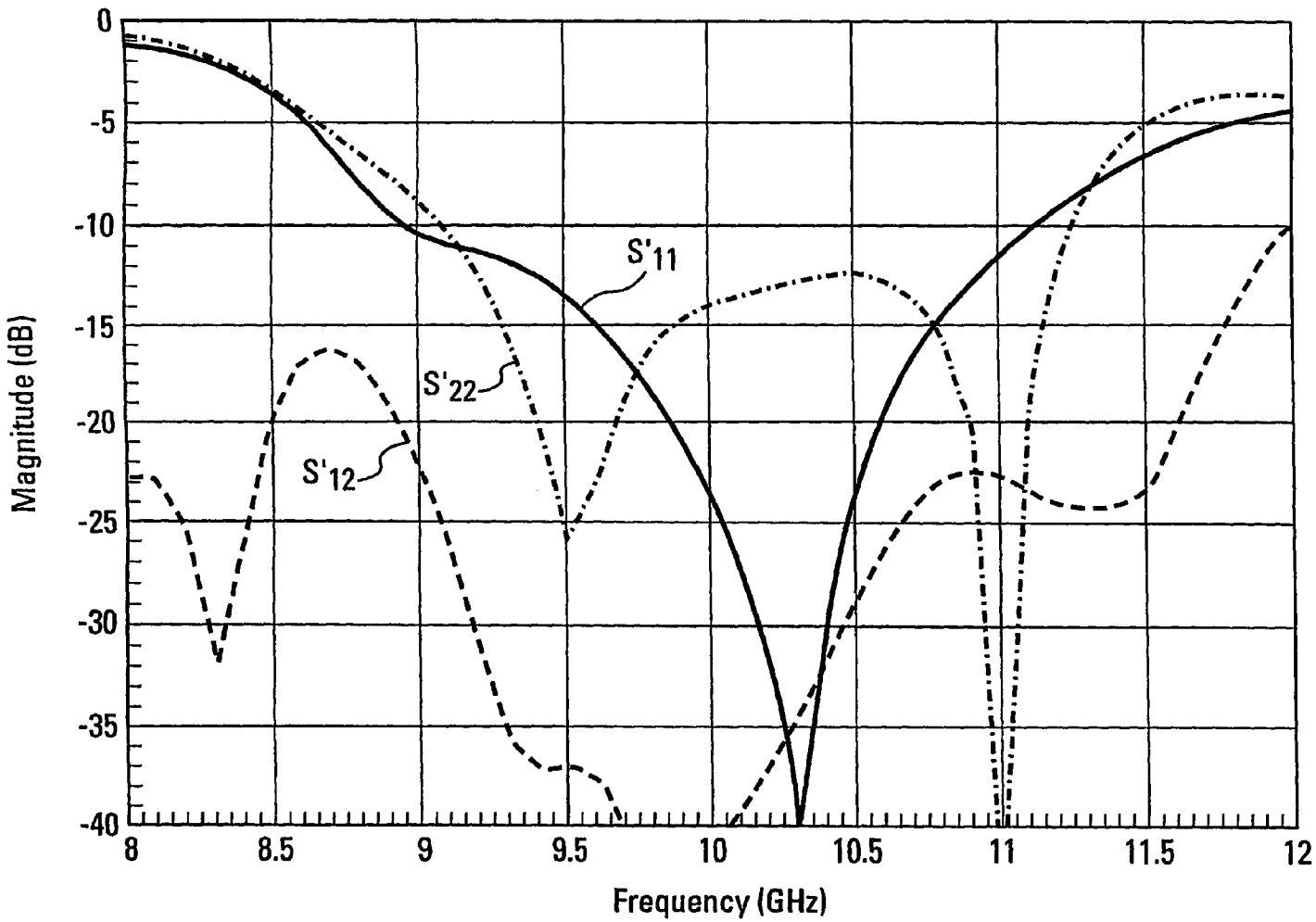
FIG. 10 represents as a function of the frequency in two curves the change of the amplitude of the coefficients of the dispersion matrix of the antenna as shown in FIG. 7.

Reference is made to FIG. 10 below where curves are presented as a function of the frequency for the change in amplitude of the coefficients of the dispersion matrix of the antenna represented in FIG. 7, using the new inputs $P_1'$ and $P_2'$. The coefficients of this matrix are noted as $S_{11}'$, $S_{12}'$, $S_{21}'$ and $S_{22}'$. For the same reasons as above, the coefficients $S_{12}'$ and $S_{21}'$ are equal. On the other hand, the coefficients $S_{11}'$ and $S_{22}'$ differ (as a result of the magic T).

The amplitude curve $S_{12}'$ lies lower than −20 dB in the 9–11.25 GHz wave band. When we compare the curve with the curve $S_{12}$ in FIG. 5, it will be noted that the insulation between the inputs has been substantially improved. Moreover, the reflections (curves $S_{11}'$ and $S_{22}'$) are less than −10 dB in an almost identical waveband.

Figure 11:
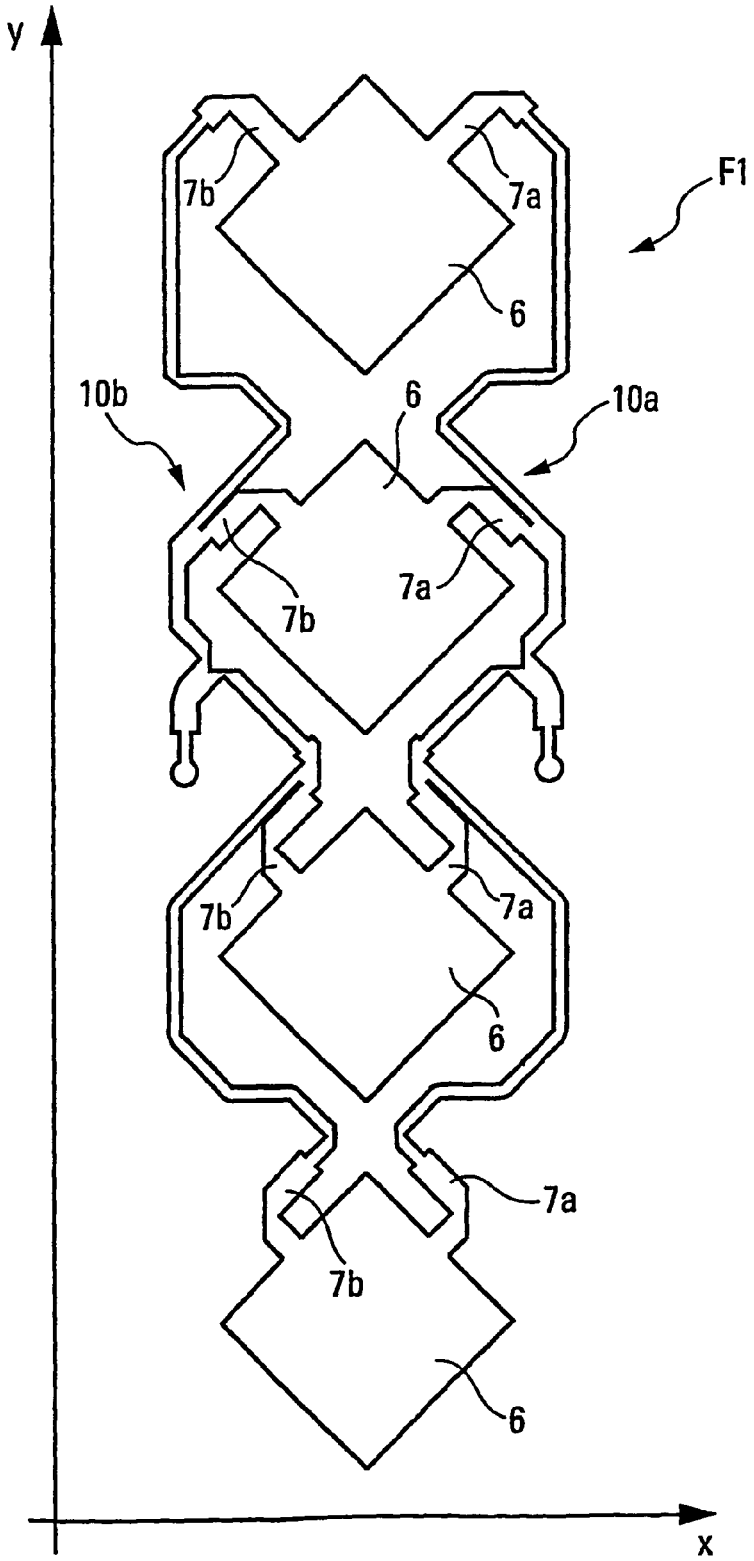
FIG. 11 represents in top view a detail of the antenna array as shown in FIG. 12.

Reference is made to FIGS. 11 and 12 below. These represent an example of an array antenna according to the invention. This array includes 80 antennas as represented in FIG. 1. The antennas are printed on the same layers and lined up along two orthogonal axes x and y. The radiating elements (not shown) are distributed in columns along the y-axis with 4 radiating elements per column and rows according to the x-axis, with 20 radiating elements per line. The feed for these radiating elements is provided by 80 feed patches (FIG. 12) that are themselves distributed in the same way into rows and columns F1, F2, F3, . . . F20. A feed patch corresponds to each radiating element, as described in the example illustrated in FIG. 1.

As illustrated by FIG. 11, the feed patches 6 in the same column F1 can be linked by a first feed network 10*a*, 10*b* printed on the same layer as the said patches. The feed patches 6 can be divided into groups of 4 with his first feed network. In the example, the feed patches 6 in column F1 are wired in series. This is the same for the other columns F2 to F20 as illustrated in FIG. 12.

The antenna array may comprise 11 layers, with 6 conductive layers and 5 dielectric layers, as described in the example illustrated by FIG. 7. More particularly, the magic Ts 13 may be placed on another layer from the feed patches 6 in order to simplify assembly of the antenna array.

Figure 8:
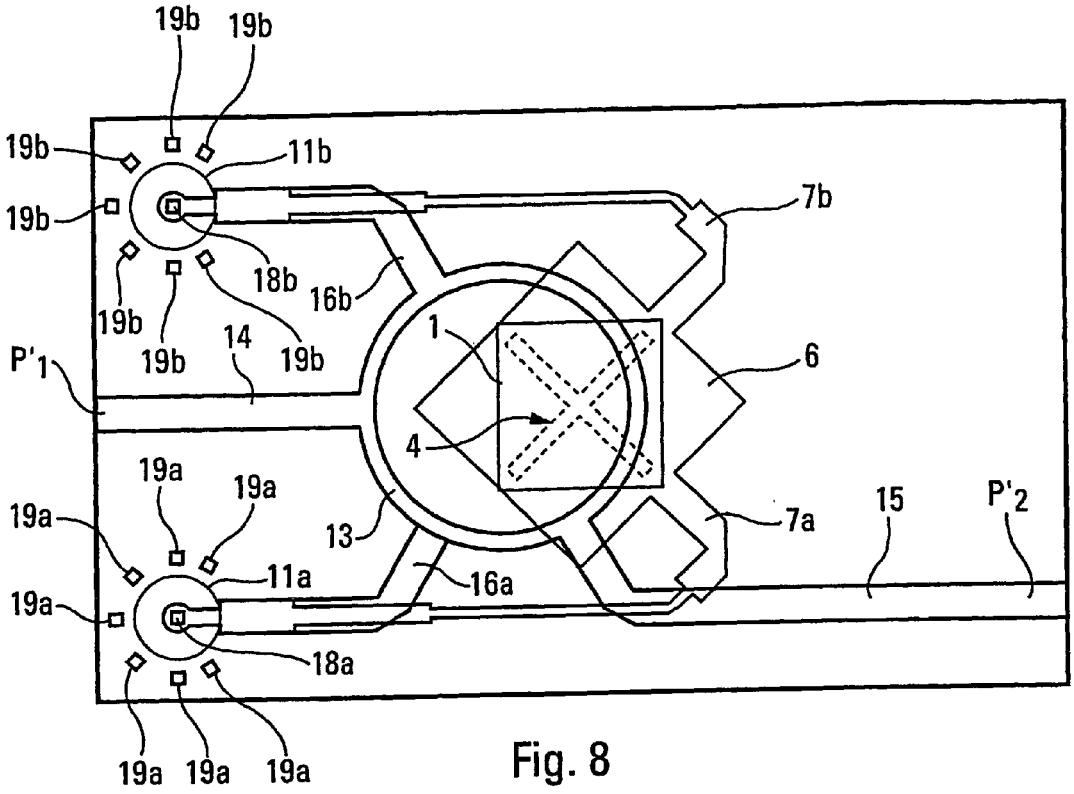
FIG. 8 represents the antenna elements in top view, shown in FIG. 7.

A magic T R1, R2 . . . R20 is associated with each column of the feed patches F1, F2 . . . F20. In other words, a single magic T is associated with a small group of feed patches. The magic Ts R1, R2 . . . R20 are assembled along the x-axis in another layer from the feed patches. Each magic T can be linked to a feed network 10*a*, 10*b* of a column of feed patches by means of vertical connections. This coupling with the aid of vertical connections is as illustrated in FIGS. 7 to 9.

The antenna array may moreover comprise a feed network 20*a*, 20*b* printed on the layer of the magic Ts R1, R2 . . . R20. A part 20*a* of this network allows the sum inputs of the magic Ts R1, R2 . . . R20 to be grouped, so that a first input 21*a* is obtained. The other part 20*b* of this feed network allows the differential inputs to be grouped, so that a second input 21*b* is obtained.

In other words, the antenna array includes a feed network 20*a*, 20*b* printed on a layer that differs from the layer of the feed patches 6, which is insulated from the latter by at least a dielectric layer 8, a ground plane 9 and another dielectric layer 11, placed on the other side of the ground plane 9, and which is linked to the layer of the feed patches 6 with the aid of vertical connections 18*a*, 18*b* diagonally through the said ground plane 9 and the said dielectric layers 8, 11.

It is clear that the number of radiating elements can be simply changed in view of the modular structure of the antenna according to the invention. The invention therefore allows a large antenna array to be devised simply and at less expense. It is also clear that the antenna may equally be a sending antenna, a receiving antenna or a sending/receiving antenna.

It is obvious that the invention is not limited to the embodiments described above. It is also clear that the invention can be applied to all frequency bands. Functions can also be added to the antenna within the framework of the present invention. By adding layers, a multi-band antenna can, for example, be achieved.

It is also clear that the shape of the elements that form the antenna or the antenna array according to the invention is not limited to the shape described here. The radiating open, the feed patches, the radiating patches (optional) can all be of different shape. The radiating opening, for example, can take the shape of a star instead of a cross. The feed patches and the radiating patches can, for example be disc-shaped.

It is also clear that the structure of the antenna and of the antenna array according to the invention is not limited to the structure described above. The dielectric layers can be replaced by layers of air, whereby the conductive layers are mutually separated by layers of air.

What is claimed is:

1. A printed antenna, comprising:

a) one conductive ground plane with a radiating opening in it, which radiating opening is designed to radiate into the space located above the ground plane;

b) one radiating feed patch placed beneath the radiating opening and insulated by a dielectric layer in such a way that the patch is coupled with the radiating opening in order to feed the radiating opening without parasitic radiation being excited, wherein:

said feed patch is substantially symmetrical in relation to an axis, that two feed lines are fastened symmetrically are connected to said patch symmetrically about said axis, these lines being intended to be fed simultaneously in phase or in counter phase so as to produce two polarizations.

2. The antenna according to claim 1, wherein the vertical projection of said radiating opening is substantially surrounded by the feed patch.

3. The antenna as defined in claim 1 which further comprises:

c) a second conductive ground plane placed beneath said feed patch and insulated by a dielectric layer, in such a way that together with the feed patch a three-layer assembly is formed.

4. The antenna as defined in claim 1, wherein said feed patch is substantially square in design and that said two feed lines are connected on two successive sides.

5. The antenna as defined in claim 1 which further comprises:

d) one or more conductive radiating patches placed above said radiating opening and insulated by dielectric layers in such a way that they are coupled with to said radiating opening so as to radiate out into the space above.

6. The antenna as defined in claim 1, wherein said feed lines are linked to a magic T, where the sum and differential inputs of the magic T form the inputs independently for each polarization.

7. The antenna as defined in claim 6, wherein said magic T is of the rat-race type.

8. An array of antennas comprising at least two printed antennas, comprising:

a) one conductive ground plane with a radiating opening in it, which radiating opening is designed to radiate into the space located above the ground plane;

b) one radiating feed patch placed beneath the radiating opening and insulated by a dielectric layer in such a way that the patch is coupled with the radiating opening in order to feed the radiating opening without parasitic radiation being excited;

c) said feed patch being substantially symmetrical in relation to an axis, two feed lines are fastened symmetrically are connected to said patch symmetrically about said axis, these lines being intended to be fed simultaneously in phase or in counter phase so as to produce two polarizations.

9. The array of antennas as defined in claim 8, which further comprises a feed network printed on a layer of feed patches.

10. The array of antennas as defined in claim 8 which further comprises a feed network printed on another layer than the layer on which the feed patches are placed, insulated from the latter layer by a dielectric layer, a ground plane and another dielectric layer placed on the other side of the ground plane and linked to the layer of the feed patches by vertical connections through the ground plane and the dielectric layers.

11. The array of antennas as defined in claim 10, wherein said vertical connections are provided with screening.

* * * * *